United States Patent [19]

Bolly

[11] Patent Number: 5,046,720

[45] Date of Patent: Sep. 10, 1991

[54] CEILING-SUSPENDED WALKING MAZE

[76] Inventor: Timothy D. Bolly, 8797 Marinér Dr., Machesny Park, Ill. 61111

[21] Appl. No.: 524,583

[22] Filed: May 17, 1990

[51] Int. Cl.[5] ..... A63J 11/00

[52] U.S. Cl. ..... 272/19

[58] Field of Search ..... 272/19, 2, 3, 1 R; 52/64, 65

[56] References Cited

U.S. PATENT DOCUMENTS

| | | | |
|---|---|---|---|
| 545,678 | 9/1895 | Castan | 272/19 |
| 760,032 | 5/1904 | Snedeker | 272/19 |
| 4,154,440 | 5/1979 | Rusk | 272/19 |

FOREIGN PATENT DOCUMENTS

| | | | |
|---|---|---|---|
| 247054 | 2/1926 | United Kingdom | 272/19 |

*Primary Examiner*—Richard E. Chilcot, Jr.

*Attorney, Agent, or Firm*—Leydig, Voit & Mayer, Ltd.

[57] ABSTRACT

An amusement maze is located inside of a building and defines a labyrinth walking path. The maze is formed by upright flexible panels which are appropriately arranged in selected longitudinally and laterally extending patterns. The panels are supported by ropes anchored to a single sidewall of the building and are suspended above the floor of the building by wires which extend upwardly to the ceiling.

9 Claims, 3 Drawing Sheets

CEILING-SUSPENDED WALKING MAZE

BACKGROUND OF THE INVENTION

This invention relates to an amusement maze adapted to be installed in a building and defining a labyrinth walking path having an entrance and an exit. The maze is arranged such that a degree of skill is required to find one's way through the various passages of the maze from the entrance to the exit.

In the past, it has been conventional to construct a walking maze in a building from rigid panels which stand from the floor. A maze of this type, however, is of rather expensive construction since the rigid panels must be supported solidly from the floor. Also, it is difficult to change the path defined by the maze and difficult to keep track of people in the maze.

SUMMARY OF THE INVENTION

The general aim of the present invention is to provide a new and improved maze which is of relatively low cost construction, which lends itself to comparatively quick and easy changeover and which makes it possible to easily detect the location of each person in the maze.

A more detailed object of the invention is to achieve the foregoing by providing a maze which is uniquely defined by flexible panels adapted to be suspended from the ceiling of the building and kept spaced above the floor.

Still another object is to provide a maze which utilizes uniquely arranged wires to suspend the panels from the ceiling and which further makes novel use of ropes to connect spaced panels securely to one another while using only one sidewall of the building as an anchor wall.

The invention also resides in the unique geometrical pattern of the wires to enable the panels of the maze to be suspended from the ceiling while using only one anchor wall for the ropes.

These and other objects and advantages of the invention will become more apparent from the following detailed description when taken in conjunction with the accompanying drawings.

DETAILED DESCRIPTION OF THE PREFERRED EMBODIMENT

Figures 1, 2, 3:
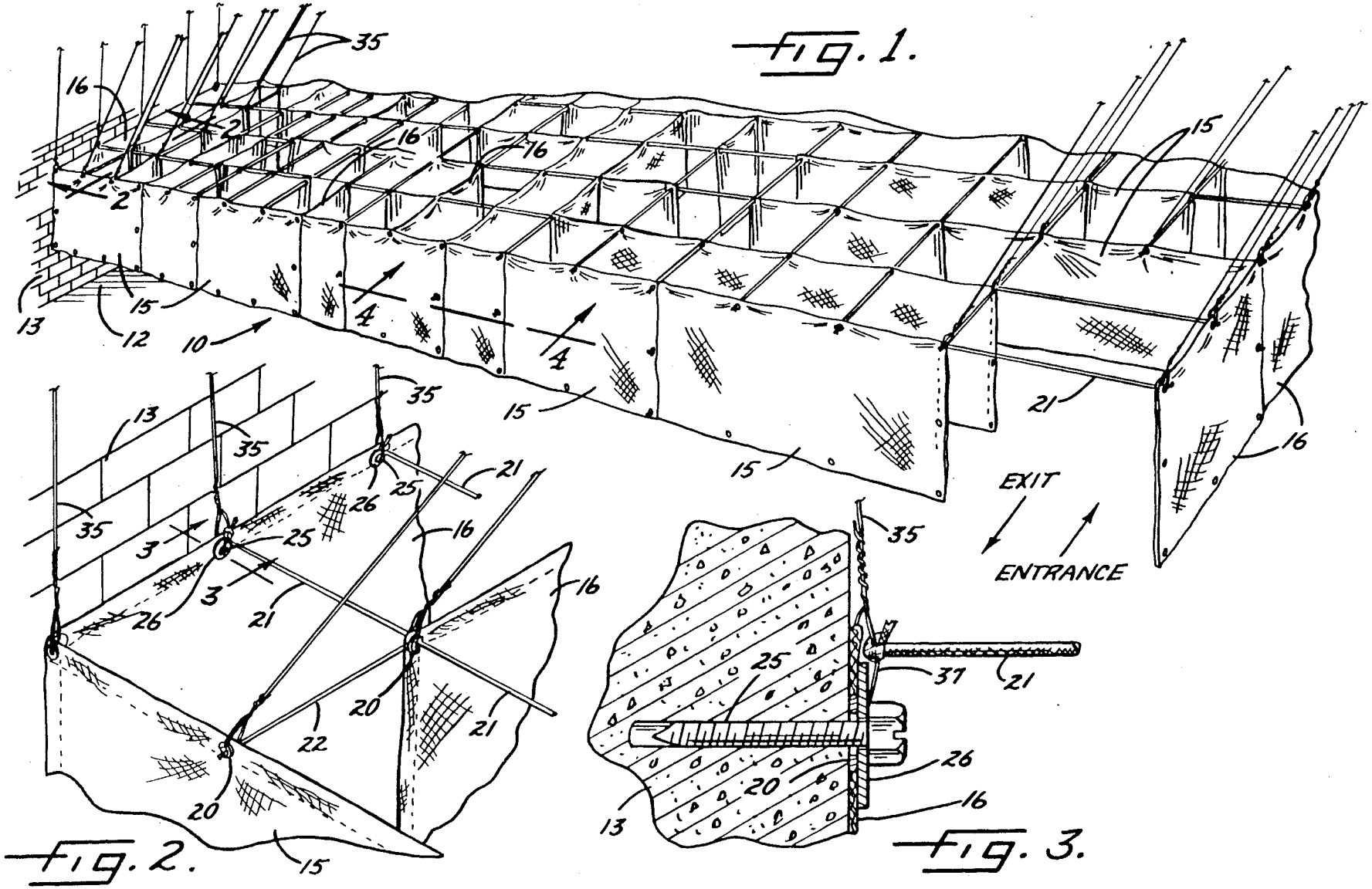
FIG. 1 is a fragmentary perspective view of a new and improved maze incorporating the unique features of the present invention.
FIG. 2 is an enlarged fragmentary perspective view of a portion of the maze adjacent the anchor wall.
FIG. 3 is an enlarged fragmentary cross-section taken substantially along the line 3—3 of FIG. 2.

For purposes of illustration, the invention has been shown in conjunction with an amusement maze 10 which defines a labyrinth walking path for challenging the skill of a person to find the proper trail from an entrance to an exit. In this instance, the entrance and exit of the maze have been shown as being at a common location although it will be appreciated that the exit could be remote from the entrance. The common entrance/exit is labeled in FIG. 1 of the drawings.

The maze 10 is intended for use as a commercial amusement or recreational facility and is installed in a building having a room with a ceiling 11 (FIG. 5), a floor 12 (FIG. 1) and four generally right-angled sidewalls. Only one sidewall has been illustrated and it has been designated by the reference numeral 13.

The present invention contemplates the provision of a maze 10 whose walls are uniquely formed by flexible panels 15 and 16 which are adapted to be suspended from the ceiling 11 and which require use of only one sidewall 13 of the building as an anchor wall. The maze is relatively inexpensive when compared with a maze having rigid floor-supported walls, can be changed over to a different pattern in a comparatively quick and easy manner and, as will become more apparent subsequently, enables the position and movement of people in the maze to be visually monitored.

More specifically, the flexible panels 15 and 16 are made of a fairly heavy and durable material such as cloth-backed vinyl, each panel being of a double layer so that each exposed side of the panel is vinyl. The panels are rectangular, have a height of about 5′ and are used in lengths of 3′, 6′ and 9′. A metallic grommet 20 (FIG. 4) is located in each of the four corners of each panel as well as midway along the height of each panel adjacent each end thereof. In the case of a 6′ panel, upper and lower grommets also are located midway along the length of the panel and, in the case of a 9′ panel, upper and lower grommets are also located about 3′ from each end of the panel. Thus, the upper and lower grommets have a pitch of about 3′ regardless of the length of the panel.

Figure 4:
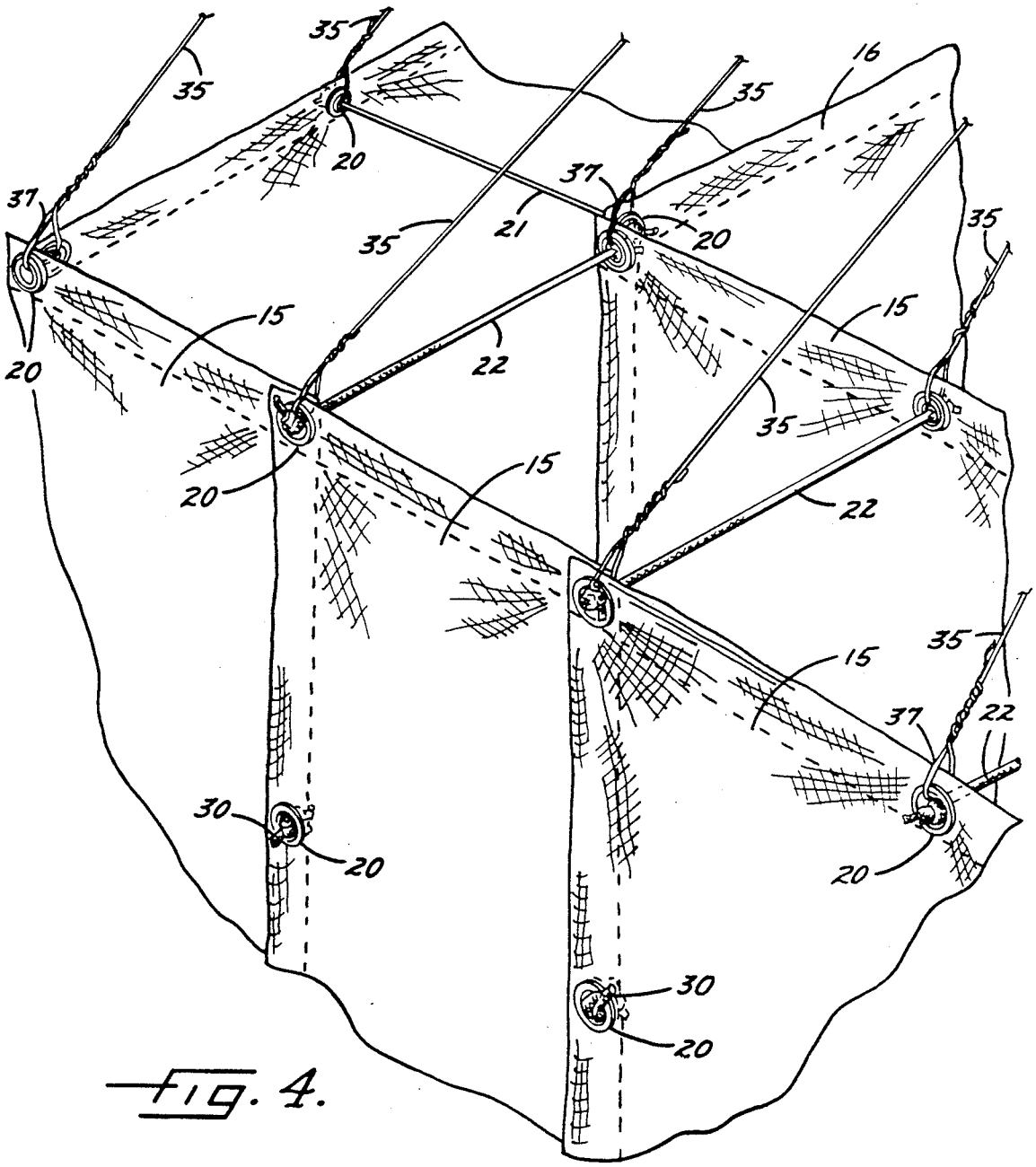
FIG. 4 is an enlarged fragmentary perspective view of a portion of the maze.

As shown most clearly in FIGS. 1 and 4, the maze 10, when viewed from above, is defined by a series of rectangular grids formed by the panels 15 and 16 and by nylon ropes 21 and 22. Each grid preferably is three foot square. The overall gridwork includes several parallel longitudinal rows (extending from left-to-right in FIG. 1) and by several parallel lateral rows which extend generally perpendicular to the longitudinal rows. The front longitudinal row (i.e., that row containing the entrance/exit) is preferably formed by consecutive interconnected panels 15 except for the space at the entrance/exit. The rear or final longitudinal row preferably is formed by consecutive interconnected panels without any intervening spaces. The two lateral end rows (i.e., the lateral rows immediately adjacent the wall 13 and immediately adjacent the entrance/exit) are formed by consecutive interconnected panels 16 without any intervening spaces. The remaining longitudinal and lateral rows are formed partially by panels 15 and 16, respectively, and partially by spaces between panels, the panels and spaces being arranged both longitudinally and laterally in a manner to create a desired labyrinth path.

The panels 16 of the lateral row immediately adjacent the anchor wall 13 preferably are connected directly to the wall as shown in FIGS. 2 and 3. For this purpose, screws 25 with washers 26 are inserted through the upper grommets 20 of the panels 16 and are threaded into the wall. Accordingly, the last lateral row of panels immediately adjacent the wall 13 forms a very rigidly suspended set of panels. The remaining lateral panels 16 are interconnected with the last lateral row of panels by the ropes 21 or by the longitudinal panels 15.

Generally speaking, there is a rope 22 along the upper portion of each lateral row wherever there is no lateral panel 16 at the grommets 20 of opposing longitudinal panels 15 or, stated differently, whenever there is a space between opposing longitudinal panels 15 at the grommets thereof. Thus, laterally extending ropes 22 extend between the upper grommets 20 of opposing longitudinal panels 15 and interconnect those panels if there is no lateral panel 16 extending between the panels 15 at the grommets. Assume, for example, that two 9' longitudinal panels 15 are disposed in opposing relation and that no lateral panel 16 is disposed between the longitudinal panels. In such an instance, four ropes 22 approximately 3' in length extend laterally across the upper end portions of the panels 15, are threaded through the upper grommets 20 thereof and are knotted at each end to keep the panels from pulling apart and to maintain a 3' maximum lateral spacing between the panels. Where panels 15 are joined end-to-end such as in the case of the panels of the front longitudinal row, short lengths of rope 30 (FIG. 4) are threaded through the grommets at the lower corners of adjacent panels and also through the mid-height grommets of adjacent panels to tie those panels together.

The rope arrangement is generally the same along the longitudinal rows. That is to say, longitudinally extending ropes 21 extend between the upper grommets 20 of opposed laterally extending panels 16 and interconnect those panels to establish a maximum 3' longitudinal spacing between the lateral panels if there is no longitudinal panel 15 extending between the lateral panels at the grommets. Adjacent ends of adjacent lateral panels are joined end-to-end by short ropes 30 extending through the lower corner and mid-height grommets.

In certain locations in the maze, a longitudinal panel 15 abuts a lateral panel 16 at right angles. When the panels abut, they may be tied together by short ropes (not visible) extending through the lower corner and mid-height grommets 20 of the panels.

Pursuant to the invention, the panels 15 and 16 and the ropes 21 and 22 are suspended from the ceiling 11 of the building by longitudinally spaced arrays of laterally spaced wires 35. The first array of laterally spaced wires 35 is shown most clearly in FIGS. 2 and 3 and is defined by wires located adjacent the anchor wall 13 and extending vertically from the grommets 20 of the last row of lateral panels 16 to beams 36 (FIGS. 5 and 6) or other framework in the ceiling. Each of the vertical wires includes a lower end portion 37 (FIG. 3) which is looped through the washer 26 of the screw 25 and is twisted upon itself to anchor the wire. The upper end portion of each vertical wire is suitably fastened to a ceiling beam 36. As shown in FIG. 3, the ends of the longitudinal ropes 21 adjacent the anchor wall 13 are tied to the looped lower end portions 37 of the vertical wires 35 and do not extend through the grommets 20 of the adjacent row of lateral panels 16 since those grommets accommodate the screws 25. There is one vertical wire 35 adjacent each grommet 20 of each lateral panel 16 in the last row and thus the vertical wires are spaced laterally from one another by a distance of 3'. The first and last of the vertical wires 35 also extend through the upper corner grommets 20 of the longitudinal panels 15 immediately adjacent the wall 13 (see FIG. 2).

Figure 5:
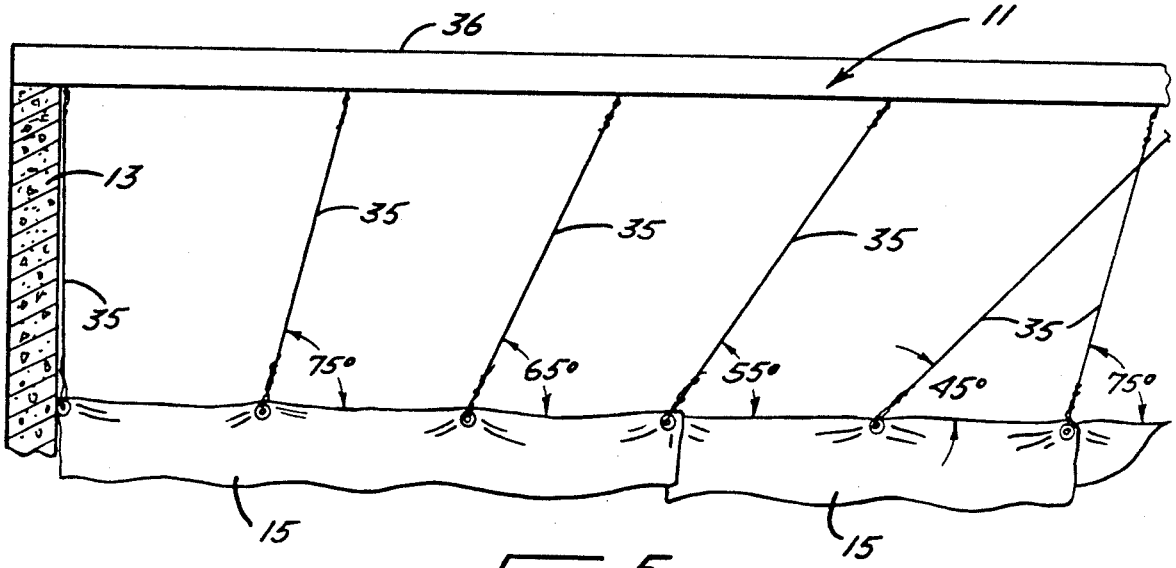
FIG. 5 is a diagrammatic view showing groups of the suspension wires in longitudinal elevation.

The wires 35 of the second array are spaced laterally at their lower ends by the same distance as the vertical wires and are anchored through the grommets 20 of either longitudinal panels 15 or lateral panels 16 or both if the panels abut one another at right angles. Instead of extending vertically, how ever, the wires of the second array diverge away from the anchor wall 13 as shown in FIG. 5 as the wires proceed upwardly from the panels to the ceiling 11. By way of example, the wires of the second array may diverge away from the wall 13 at an angle of about 15 degrees. As a result, the wires of the second array apply tension to the longitudinal panels 15 and the longitudinal ropes 21 in order to keep those components tight.

The third array of laterally spaced wires 35 is the same as the second except that the wires of the third array diverge away from the wall 13 at a greater angle (e.g., 25 degrees) as is apparent from FIG. 5. The fourth array diverges at a still greater angle such as 35 degrees while the fifth array diverges away from the wall 13 at an angle of about 45 degrees. The next array, however, diverges at a smaller angle of about 15 degrees and then the diverging pattern continuously repeats as the arrays progress toward the entrance/exit end of the maze 10. In this way, the longitudinal panels 15 and the longitudinal ropes 21 are kept in tension as they progress away from the wall 13.

Figure 6:
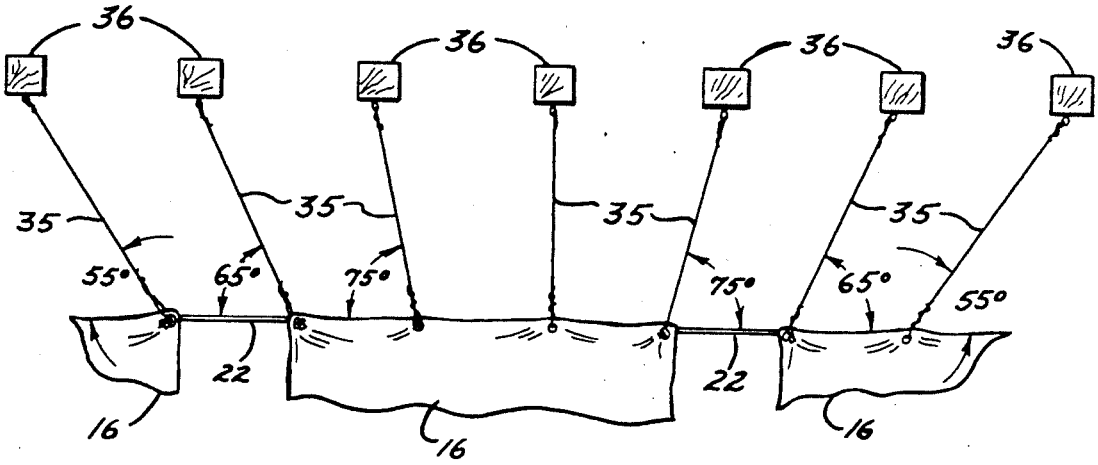
FIG. 6 is a diagrammatic view showing a group of suspension wires in lateral elevation.

In addition to diverging away from the wall 13, the laterally spaced wires 35 of each array except the vertical array fan laterally as the wires progress from the longitudinal centerline of the maze 10. This is best illustrated in FIG. 6 where it will be seen that the laterally spaced wires on one side of the longitudinal centerline diverge away from a longitudinally extending and laterally centered vertical plane at progressively greater angles as the wires progress laterally outwardly from the longitudinal centerline. The wires on the other side of the longitudinal centerline diverge in the same manner but are sloped in the opposite direction. By virtue thereof, the laterally extending panels 16 and ropes 22 are kept in tension.

A significant advantage of the suspended maze 10 resides in the fact that the lower edges of the panels 15 and 16 may be spaced upwardly a significant distance (e.g., 3') from the floor 12. As a result, the person attending the maze may look beneath the panels to monitor the location and progress of persons walking through the maze. This enables the attendant to assist someone who may have panicked, to maintain a reasonable flow of traffic through the maze and to interrupt any horseplay.

Because the maze 10 requires only one sidewall 13 of the building as an anchor wall, the maze may be spaced from the other three sidewalls so as to enable the areas between the maze and such sidewalls to be utilized for other purposes (e.g., concession stands, other amusement devices, etc.). It should be appreciated, however, that the maze could be anchored to two or three sidewalls if desired.

I claim:

1. A maze for installation in a building having sidewalls and a ceiling, said maze defining a labyrinth walking path having an entrance and an exit, said maze being defined by parallel longitudinal rows of upright flexible panels with each of said longitudinal rows having a plurality of first panels and with at least some of said longitudinal rows having spaces between selected ones of the first panels in the row, said maze further being defined by parallel lateral rows of upright flexible panels with each of said lateral rows having a plurality of second panels and with at least some of said lateral rows having spaces between selected ones of the second panels in the row, said longitudinal and lateral rows extending generally perpendicular to one another, a plurality of first ropes extending along selected upper portions of said longitudinal rows and connected to selected ones of said second panels, each of said first ropes extending generally perpendicular to one of said sidewalls, some of said first ropes each having one end portion anchored to said one sidewall, a plurality of second ropes extending along selected upper portions of said lateral rows and connected to selected ones of said first panels, and upwardly extending wires connected to said panels and anchored to said ceiling to suspend said panels and said ropes from said ceiling.

2. A maze as defined in claim 1 in which said wires include a first array of laterally spaced wires connected to selected panels adjacent said one wall, said wires of said first array extending substantially vertically to said ceiling.

3. A maze as defined in claim 2 in which said wires include a second array of laterally spaced wires connected to selected panels, the wires of said second array being spaced further from said one wall than the wires of said first array, and the wires of said second array diverging away from said one wall at a predetermined angle as the wires of said second array progress upwardly from said panels toward said ceiling.

4. A maze as defined in claim 3 in which said wires include a third array of laterally spaced wires connected to selected panels, the wires of said third array being spaced further from said one wall than the wires of said second array, and the wires of said third array diverging away from said one wall at a second angle greater than said predetermined angle as the wires of said third array progress upwardly from said panels toward said ceiling.

5. A maze as defined in claim 4 in which said wires include an additional array of laterally spaced wires connected to selected panels, the wires of said additional array being spaced further away from said one wall than the wires of said third array, the wires of said additional array diverging away from said one wall at an angle less than said second angle as the wires of said additional array progress upwardly from said panels toward said ceiling.

6. A maze as defined in claim 1 in which said wires include several longitudinally spaced arrays of laterally spaced wires, said maze having a longitudinally extending centerline, the laterally spaced wires of at least some of said arrays diverging away from a vertical plane through said centerline as such wires progress upwardly from said panels toward said ceiling, the wires on one side of said plane diverging in one lateral direction and the wires on the other side of said plane diverging in the opposite lateral direction.

7. A maze as defined in claim 6 in which the wires of each diverging array diverge away from said plane at progressively increasing angles as the individual wires of such array proceed laterally from said plane.

8. A maze as defined in claim 5 in which said maze includes a longitudinal centerline, the laterally spaced wires of at least some of said arrays diverging away from a vertical plane through said centerline as such wires progress upwardly from said panels toward said ceiling, the wires on one side of said plane diverging in one lateral direction and the wires on the other side of said plane diverging in the opposite lateral direction.

9. A maze as defined in claim 8 in which the wires of each diverging array diverge away from said plane at progressively increasing angles as the individual wires of such array proceed laterally from said plane.

* * * * *